US006122943A

United States Patent [19]

DaWalt et al.

[11] Patent Number: 6,122,943

[45] Date of Patent: Sep. 26, 2000

[54] SLIDING DOOR LOCK

[75] Inventors: Christopher Hale DaWalt; Mark Edward Dearing, both of Indianapolis, Ind.

[73] Assignee: Best Lock Corporation, Indianapolis, Ind.

[21] Appl. No.: 09/253,076

[22] Filed: Feb. 19, 1999

[51] Int. Cl.[7] ..... E05B 65/08

[52] U.S. Cl. ..... 70/100; 70/367; 70/371; 70/379 R

[58] Field of Search ..... 70/95, 99, 100, 70/367, 368, 369, 370, 371, 379 R, 380, 361, 373

[56] References Cited

U.S. PATENT DOCUMENTS

| | | | |
|---|---|---|---|
| 1,247,532 | 11/1917 | Heath . | |
| 1,342,728 | 6/1920 | Welch . | |
| 1,499,444 | 7/1924 | Caillois . | |
| 2,766,611 | 10/1956 | Hagel | 70/379 R |
| 3,068,682 | 12/1962 | Russell et al. . | |
| 3,102,411 | 9/1963 | Friedman . | |
| 3,721,112 | 3/1973 | Wellekens . | |
| 3,798,935 | 3/1974 | Blekking et al. . | |
| 4,380,915 | 4/1983 | Kincaid et al. . | |
| 4,414,828 | 11/1983 | Takinami et al. | 70/84 |
| 4,444,034 | 4/1984 | Best et al. . | |
| 4,672,827 | 6/1987 | Craig | 70/367 |
| 4,722,204 | 2/1988 | Foshee . | |
| 4,768,360 | 9/1988 | Foshee | 70/100 |
| 4,809,525 | 3/1989 | Cox | 70/100 |
| 5,136,869 | 8/1992 | Best | 70/369 |
| 5,193,372 | 3/1993 | Sieg et al. | 70/369 |
| 5,212,972 | 5/1993 | Kincaid et al. | 70/208 |

FOREIGN PATENT DOCUMENTS

| | | |
|---|---|---|
| 1915618 | 10/1970 | Germany . |
| 27 48 045 A1 | 5/1978 | Germany . |
| 33 42 458A1 | 6/1985 | Germany . |
| 24307 | of 1895 | United Kingdom . |
| 1005853 | 9/1964 | United Kingdom . |

OTHER PUBLICATIONS

Prior art Kenstan sliding door lock photographs 1–11 (date unknown).

*Primary Examiner*—Lynne H. Browne
*Assistant Examiner*—John B. Walsh
*Attorney, Agent, or Firm*—Barnes & Thornburg

[57] ABSTRACT

A locking mechanism includes a lock mount (10) and a lock core (50). The lock mount (10) includes front and rear mount faces (15, 14) and an inner mount wall (17) which defines a core-receiving chamber (18) extending from the front mount face (15) to the rear mount face (14). The lock core (50) is slidably mounted within the core-receiving chamber (18) of the lock mount (10) and is movable between a projected position and a retracted position. The lock core (50) further includes a core body (52) and an outer core surface (49) defining a core boundary. The lock core (50) further includes a lock lug (75) coupled to the core body (52) and movable between a first lug position outside the core boundary and a second lug position within the core boundary and a travel limit stop (90) coupled to the core body (52) and movable between a first limit stop positioned outside the core boundary and a second limit stop positioned within the core boundary. Additionally, the lock core (50) includes a key plug (59) rotatable within the core body (52) which interacts with the travel limit stop (90) to move the travel limit stop (90) between the first and second limit stop positions.

21 Claims, 8 Drawing Sheets

SLIDING DOOR LOCK

BACKGROUND AND SUMMARY OF INVENTION

The present invention relates to a locking mechanism for sliding doors or panels. More particularly, the present invention relates to a sliding door lock having a lock mount that is mountable in a first sliding panel and a lock core that is movable within the lock mount.

Sliding panels are used in cases and cabinets to secure items in the cases and cabinets. It is known to secure and lock these sliding panels as shown in U.S. Pat. Nos. 4,768,360 and 4,722,204 to Foshee.

According to the present invention, a locking mechanism is provided to prevent relative movement of first and second sliding panels arranged in side by side passing relation. The lock mount mounted in the first sliding panel has an inner wall defining a core-receiving chamber. The lock core has a key way for receiving a key and is slidably mounted in the core receiving chamber for movement between projected and retracted positions. In its retracted position, the lock core permits unhindered movement of the second sliding panel in relation to the first sliding panel. In its projected position, the lock core substantially blocks movement of the second sliding panel in relation to the first sliding panel. In this way, the lock core itself is positioned to intercept and engage an edge of the second sliding panel to block relative movement of the first and second sliding panels thereby locking the panels closed.

A control key cooperates with the lock core to permit a user to slide the lock core back and forth from "locked/projected" to "unlocked/retracted" positions within the lock mount. However, the control key will not allow a user to entirely remove the lock core from the lock mount. A second key, called an operation key, will typically be utilized by fewer users than the control key and is necessary to effect complete removal of the lock core from the lock mount. For example, control keys may be used by store employees or others who must be able to lock and unlock a cabinet or other compartment having sliding doors. However, the operation key may normally be used only by a store owner who may have need to entirely remove the lock core from the lock mount and possibly change the lock core.

In a "non-key-retained" embodiment, the control key can be removed from the lock core when the lock core is in its retracted/unlocked position. This may be useful when it is desirable to allow users to remove their keys from the lock core when the lock core is in its retracted/unlocked position. In a "key retained" embodiment, the control key cannot be removed when the lock core is in its unlocked/retracted position. To remove the control key in this embodiment, a user must return the lock core to its "projected/locked" position. This may be useful in situations where a store owner desires employees using control keys to always return the lock core to its projected/locked position prior to removing their control keys.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

A locking mechanism having an interchangeable lock core moveably mounted within a lock mount is illustrated in FIGS. 1 through 13. The lock mount is typically mounted within a first sliding panel. A second sliding panel is slidably positioned in a parallel relationship with the first sliding panel. The interchangeable lock core is movable between an "unlocked" position retracted within the lock mount and a "locked" position projected outside the lock mount to prevent the second sliding panel from freely passing by the first.

Figure 1:
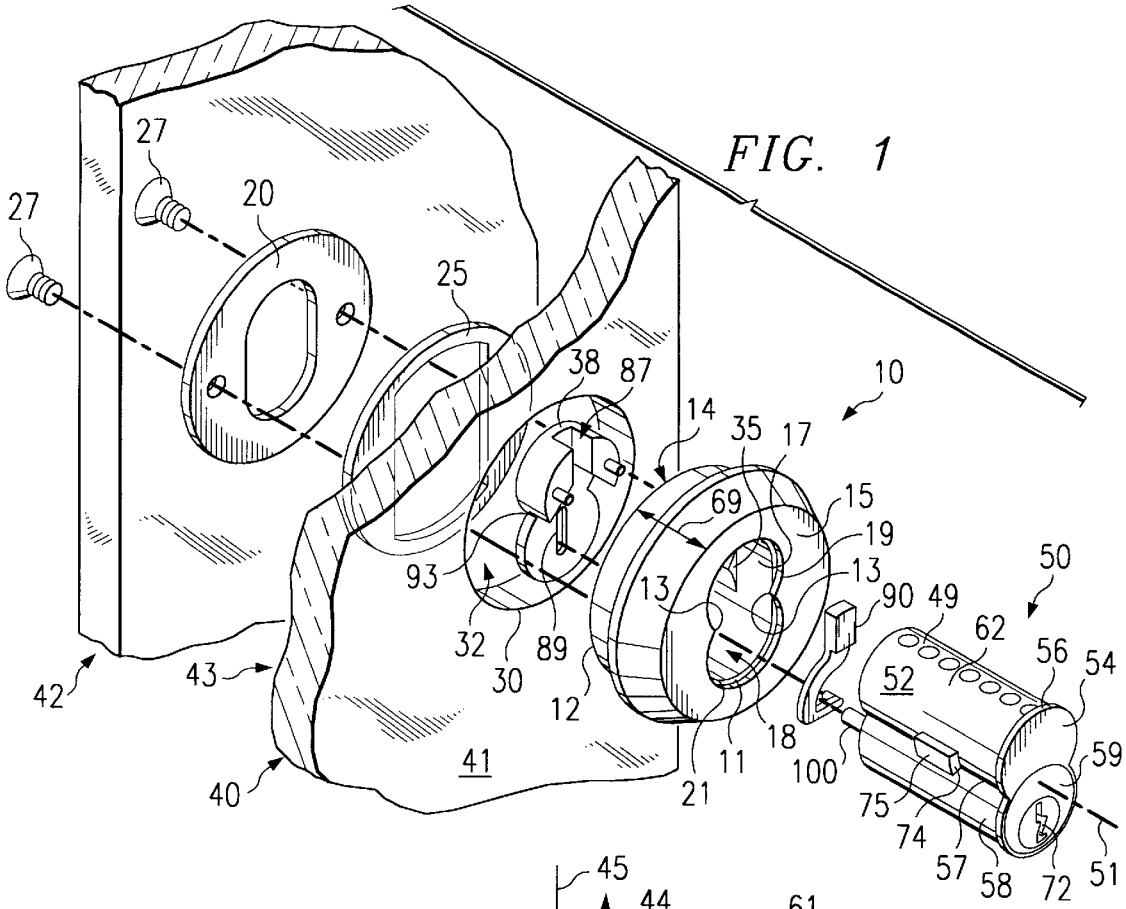
FIG. 1 is an exploded perspective view of a first sliding panel, a second sliding panel, and a locking mechanism including from left to right, assembly bolts, a clamp plate, a clamp plate washer, a casing, a lock mount, a travel limit stop, and an interchangeable lock core.
Figure 2:
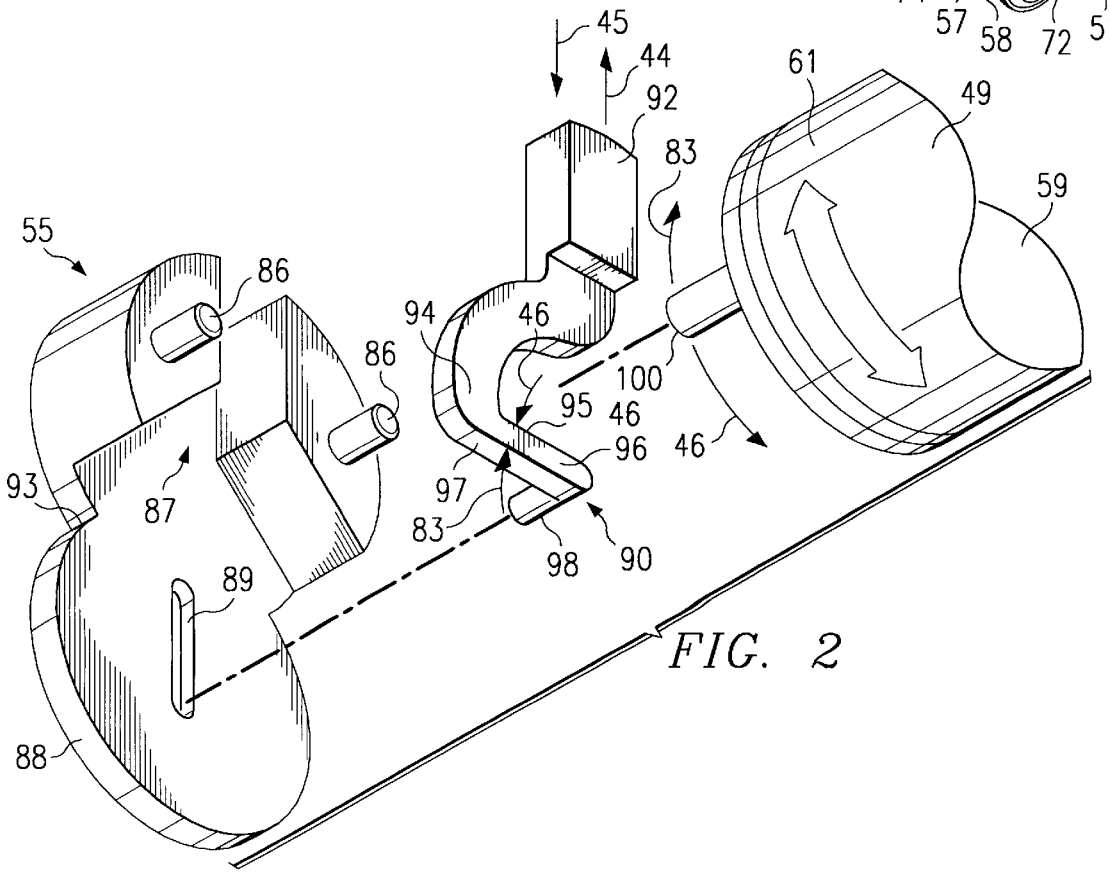
FIG. 2 is an exploded detail of the components which comprise a travel limit mechanism which can prevent the lock core from being completely removed from the lock mount, the travel limit mechanism including the casing, the travel limit stop, and a cam that is mounted to a core body of the lock core.
Figure 3:
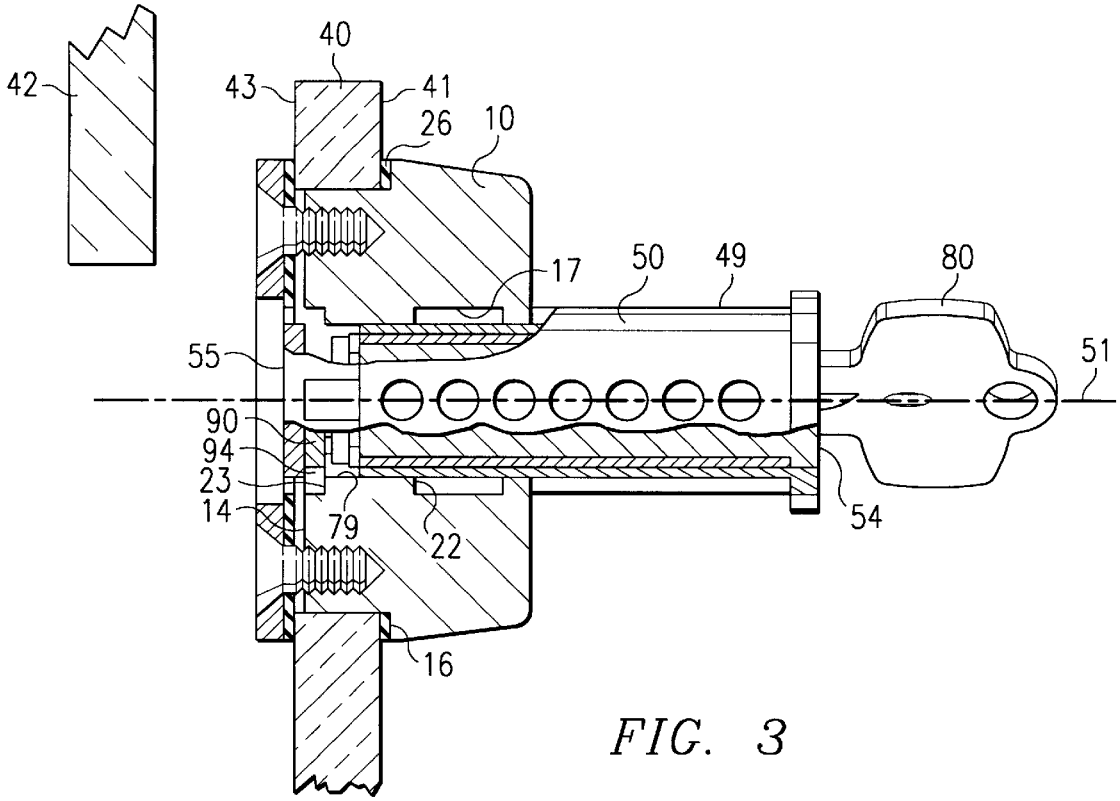
FIG. 3 is a top view, with portions cut away, of the interchangeable lock core in a retracted/unlocked position within the lock mount, including a control key inserted into the lock core and rotated approximately 15° clockwise such that the lock core is permitted to slide within the lock mount.

The locking mechanism illustrated in FIGS. 1 through 13 includes an interchangeable lock core 50, a lock mount 10, a clamp plate 20, a clamp plate washer 25, a lock mount washer 26 and assembly bolts 27. In preferred embodiments, washers 25, 26 are made of vinyl or other similar material and provide a cushion so that lock mount 10 may be mounted on glass doors or panels. As best shown in FIGS. 1, 3, and 5, lock mount 10 is mountable on a first sliding panel 40, having front and rear panel faces 41, 43 respectively, and cooperates with lock core 50 to block relative movement of first sliding panel 40 and an adjacent second sliding panel 42. As is customary, first and second sliding panels 40, 42 ride in tracks (not shown) which define two travel paths in spaced apart parallel relation.

As shown in FIG. 1, a panel opening 30 in first sliding panel 40 defines a panel chamber 32 in which lock mount 10 is mounted. Lock mount 10 includes a rear protrusion 12, a rear mount face 14, and a rear flange 16, as shown in FIG. 3. Lock mount 10 is positioned to lie with rear protrusion 12 extending into panel chamber 32 in first sliding panel 40. Lock mount washer 26 is positioned to lie between the front panel face 41 of first sliding panel 40 and rear flange 16 of the lock mount 10. With lock mount 10 so positioned, clamp plate washer 25 and clamp plate 20 are then secured to rear mount face 14 of lock mount 10 at rear panel face 43 of first sliding panel 40 using assembly bolt 27. Thus, first sliding panel 40 is sandwiched between clamp plate 20 and clamp plate washer 25 on rear panel face 43 of first sliding panel 40 and lock mount washer 26 and lock mount 10 on front panel face 41 of first sliding panel 40.

Lock mount 10 further includes a front mount face 15 and a core-receiving chamber 18 extending between front mount face 15 and rear mount face 14 of lock mount 10. Between front and rear mount faces 15, 14 is a mount depth 69. Core-receiving chamber 18 is defined by an inner mount wall 17 of lock mount 10, as best shown in FIG. 1. Front mount face 15 of lock mount 10 includes a core-receiving aperture 19 which provides an opening to core-receiving chamber 18 and is of figure-eight shape to admit lock core 50 that has a figure-eight shape. In alternative embodiments, the lock core and core-receiving aperture may be of any corresponding shape. A pair of inwardly projecting studs 13 are formed in front mount face 15 of lock mount 10 along an intersection line dividing in half core-receiving aperture 19, as best shown in FIG. 1. Lock mount 10 further includes a lip 11 and a mount lug 35 that cooperate in the manner to be described below to aid in retaining lock core 50 in selected projected/locked and retracted/unlocked positions within core-receiving chamber 18 of lock mount 10. Lip 11 is situated at the interface between inner mount wall 17 and front mount face 15 of lock mount 10 and includes an oblong forwardly-facing surface 21 that substantially encircles core receiving chamber 18. Mount lug 35 is situated in core-receiving chamber 18 between lip 11 and rear mount face 14 of lock mount 10 and is positioned on inner mount wall 17 to extend into the interior of core-receiving chamber 18.

Mount lug 35 includes a front mount lug face 22 and a rear mount lug face 23, as best shown in FIG. 3.

Figure 5:
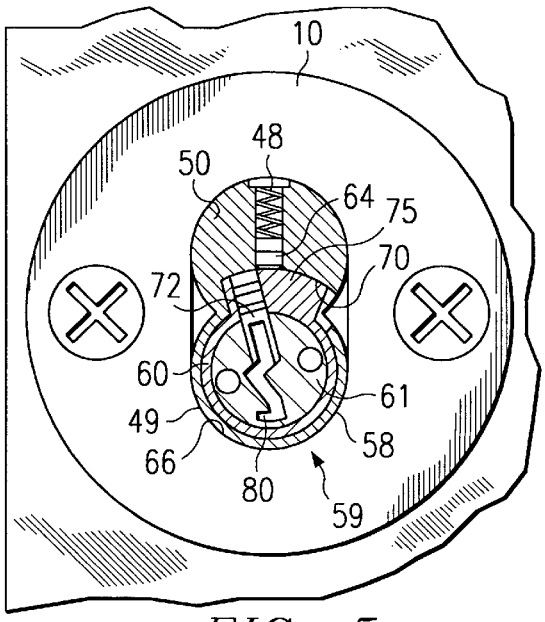
FIG. 5 is a rear elevational view, with portions cut away, of the interchangeable lock core and the lock mount of FIG. 3 showing the control key rotated approximately 15° clockwise within the lock core, thereby positioning a lock lug in a recessed/unlocked position.
Figure 6:
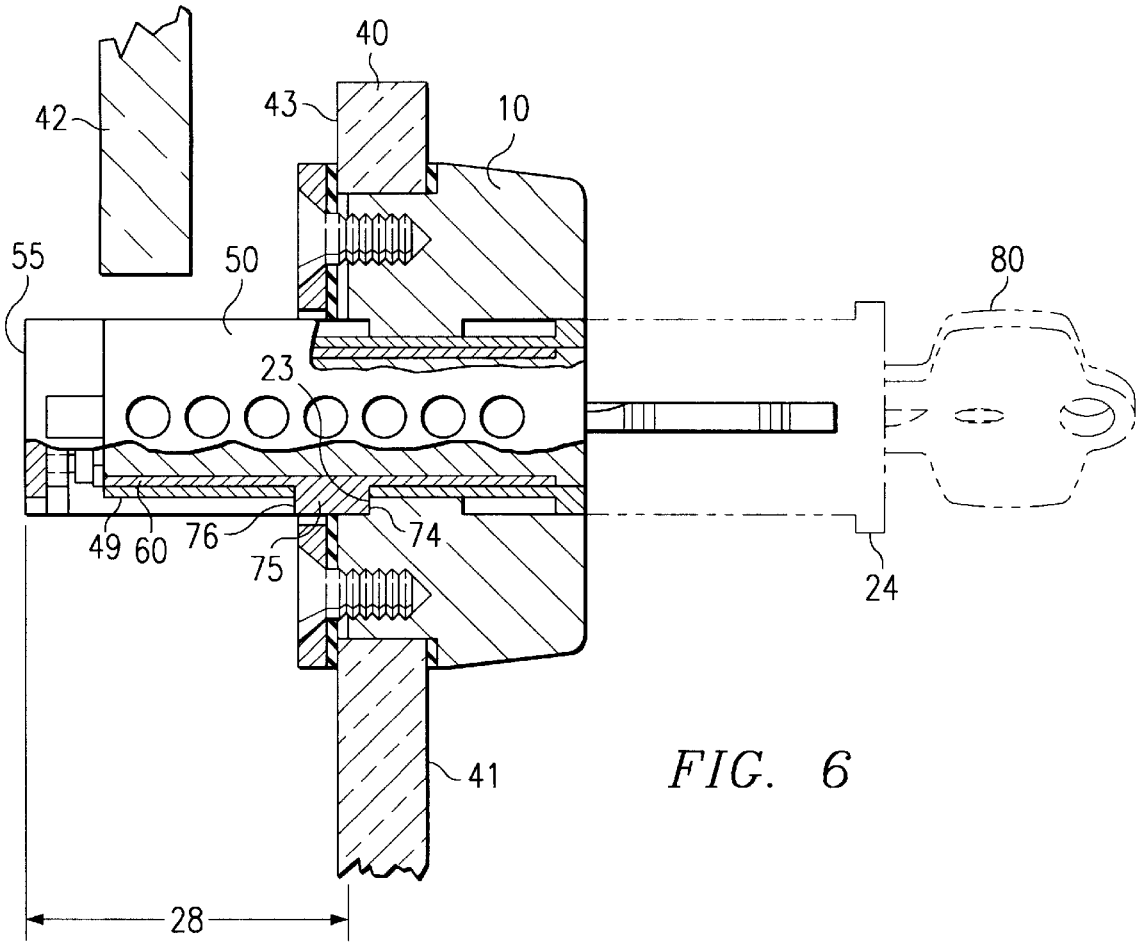
FIG. 6 is a top view, with portions cut away, of the interchangeable lock core in a projected/locked position within the lock mount to block sliding movement of the first and second sliding panels, including the lock lug in an extended/locked position.

As shown in FIG. 1, the interchangeable lock core 50 includes a core body 52 which includes a figure-eight shape cross-section. In alternative embodiments, the core body may have any cross sectional shape. Core body 52 includes an outer surface 49 that defines a core boundary. Lock core 50 also includes a front core face 54 enlarged in relation to core body 52 to define an outwardly extended peripheral flange 56, a rear core face 55, and a longitudinal axis 51 extending therebetween, as best shown in FIGS. 1, 2 and 3. As shown in FIGS. 1 and 3, core body 52 has a lower lobe 58 which contains a key plug 59 and a thin-walled core sleeve 60 (shown in FIG. 5), an upper lobe 62 which contains the pin tumblers 64 and their biasing springs 48, and a body groove 57 at the interface of upper and lower lobes 62, 58. Core body 52 is adapted to be mounted for sliding movement in lock mount 10. As best shown in FIG. 5, lower lobe 58 of core body 52 is formed with a cylindrical bore 66 in which thin-walled core sleeve 60 is mounted for limited rotation. Cylindrical bore 66 is in open communication with a wide fantailed slot 70 (shown best in FIG. 7) formed in upper lobe 62 of core body 52 with the side wall of slot 70 milled away to pass a core-retaining lock lug 75. Lock lug 75 includes a front lock lug face 74 and rear lock lug face 76, as best shown in FIG. 6.

As shown in FIG. 5, key plug 59 comprises a cylindrical body portion 61, desirably made from solid stock, which extends completely through core sleeve 60 and has a close working fit with core sleeve 60. Cylindrical body portion 61 has a rear cylindrical body portion face 63. Key plug 59 is formed with an axial broached key way 72 that is rotatably mounted within core sleeve 60.

Figure 7:
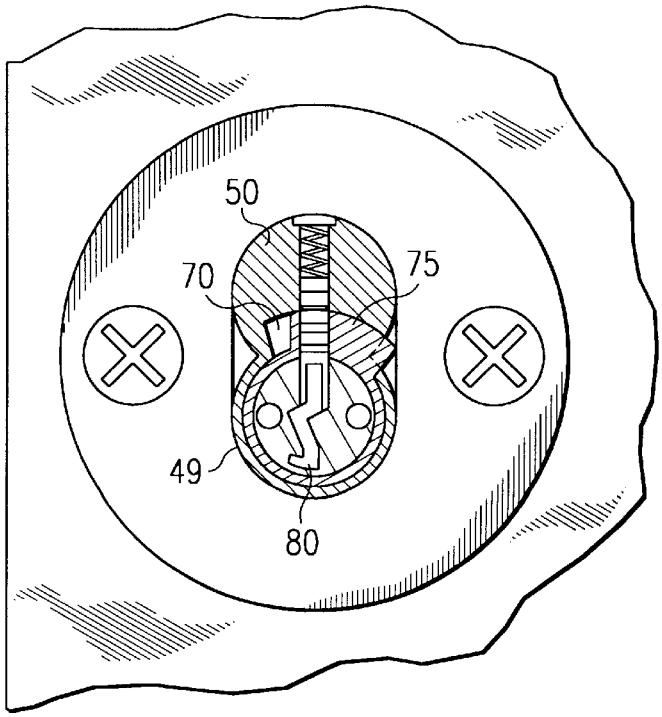
FIG. 7 is a rear elevational view, with portions cut away, of the interchangeable lock core and the lock mount of FIG. 6 showing the control key rotated to a vertical position within the lock core, thereby positioning the lock lug in an extended/locked position.

Core sleeve 60 is rotatable through an angle of approximately 15 degrees in a clockwise direction (as perceived by one turning the key) to rotate lock lug 75 from an extended/locked position projected away from lock core 50, as shown in FIG. 7, to a recessed/unlocked position within lock core 50, as shown in FIG. 5. Thus, core sleeve 60 is rotatable by means of a control key 80 inserted into key way 72 to permit interchangeable lock core 50 to slide in core-receiving chamber 18 between a projected/locked position, shown in FIG. 6, and a retracted/unlocked position, shown in FIG. 3.

Coupled to lock core 50 is a travel limit stop casing 88 having a slot 89, an alignment channel 87, and a casing groove 93, as shown in FIGS. 1 and 2. Casing groove 93 cooperates with body groove 57 to define a stop channel 79, shown in FIG. 3. Travel stop casing 88 includes mounting pins 86 which fit within mounting holes (not shown) in rear core face 55 of lock core 50. Between casing 88 and interchangeable lock core 50 is positioned to lie a travel limit stop 90 having an alignment lug 92, an elbow 94, a forearm 96, a pin 98, a top surface 95, and a bottom surface 97. Travel limit stop 90 is free to move in an up and down relationship to the casing 88 wherein pin 98 of travel limit stop 90 rides vertically within slot 89 and alignment lug 92 of travel limit stop 90 rides vertically in alignment channel 87.

Figure 4:
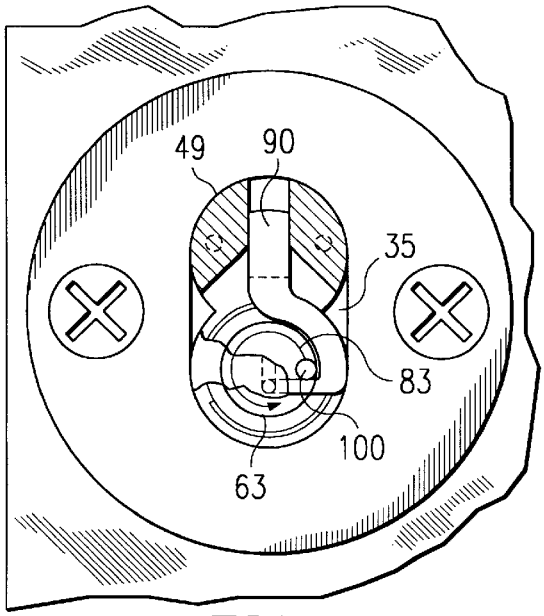
FIG. 4 is a rear elevational view, with portions cut away, of the interchangeable lock core and the lock mount of FIG. 3 showing the travel limit stop in a downward/unlocked position.
Figure 8:
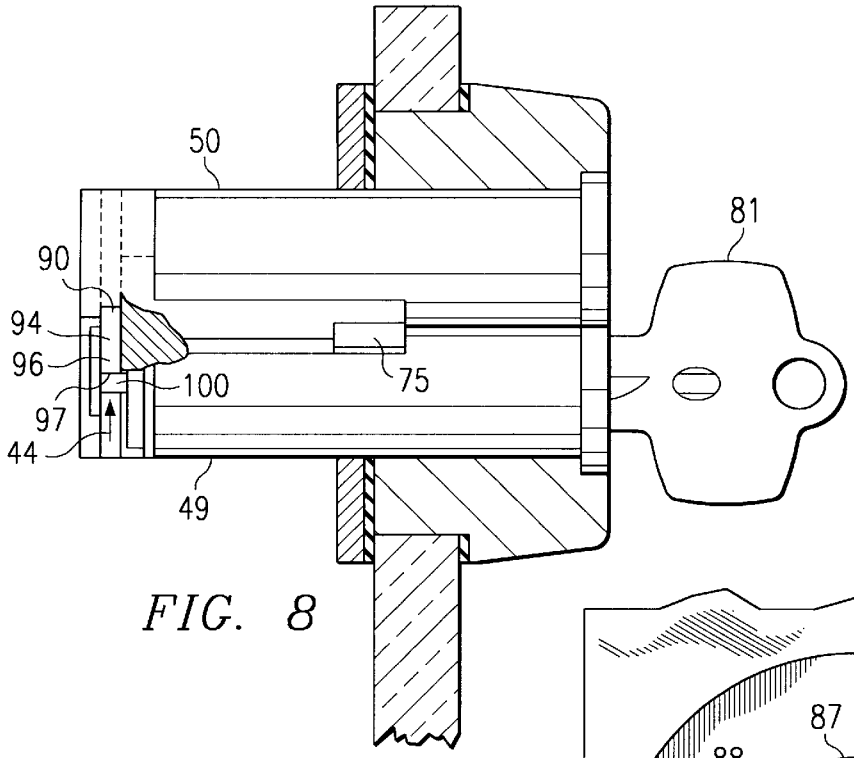
FIG. 8 is a side elevational view, with portions cut away, of the interchangeable lock core in a projected/locked position within the lock mount, including an operation key having been rotated 360° in a clockwise direction to a vertical position within the lock core, thereby having rotated the cam causing the travel limit stop to move in the direction of the arrow to an upward/locked position, thereby preventing complete removal of the interchangeable lock core from the lock mount.
Figure 9:
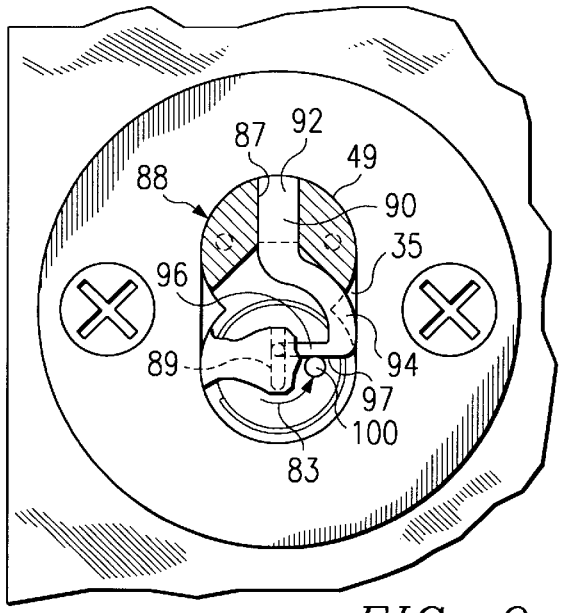
FIG. 9 is a rear elevational view, with portions cut away, of the interchangeable lock core and the lock mount of FIG. 8 showing the travel limit stop in its upward/locked position, thereby preventing removal of the interchangeable lock core from the lock mount.

As shown in FIGS. 2, 4, and 9, an operation key 81 (as shown in FIG. 8) functions to move travel limit stop 90 between two positions. The first position, shown in FIG. 4, places travel limit stop 90 in its downward/unlocked position. In this position, travel limit stop 90 is within the core boundary and thus moved out of the way of mount lug 35 of lock mount 10 to permit lock core 50 to be completely removed from lock mount 10.

As shown in FIGS. 2 and 4, the lock core includes a cam 100 coupled to rear cylindrical body portion face 63 of cylindrical body portion 61 of key plug 59. Operation key 81 rotates cylindrical body portion 61, and thus cam 100, to move travel limit stop upward in direction 44 or downward in direction 45.

To move travel limit stop 90 to its upward/locked position, operation key 81 rotates cam 100 in the direction of the arrow 83, as shown in FIG. 4, to a position abutting bottom surface 97 of forearm 96 of travel limit stop 90, as shown in FIG. 9. A lost motion driving connection exists between cam 100 and travel limit stop 90 because cam 100 can be rotated from the position shown in FIG. 4 to the position shown in FIG. 9 without moving travel limit stop 90. The lost motion driving connection between cam 100 and travel limit stop 90 is possible because travel limit stop 90 is not rigidly connected to key plug 59. Once cam 100 contacts bottom surface 97, it begins pushing travel limit stop 90 in an upward direction 44, as shown in FIG. 9, wherein pin 98 of travel limit stop 90 rides in a vertical direction within slot 89 of casing 88 and alignment lug 92 of travel limit stop 90 rides in a vertical direction within alignment channel 87 of casing 88. With travel limit stop 90 in its uppermost position, as shown FIG. 9, elbow 94 of travel limit stop 90 lies outside the core boundary and thus interchangeable lock core 50 is prevented from being removed from lock mount 10.

To move travel limit stop 90 to its downward/unlocked position, the operation key 81 rotates cam 100 in direction 46. When cam 100 is rotated in direction 46, the cam 100 engages top surface 95 of forearm 96 and pushes travel limit stop 90 downwardly in direction 45.

FIGS. 3 through 13 illustrate, step-by-step, the "non-key retained" embodiment of the present invention. FIG. 3 shows control key 80 rotated approximately 15 degrees clockwise within interchangeable lock core 50 so that lock lug 75 is positioned within fantail slot 70 in a recessed/unlocked position. FIG. 3 depicts interchangeable lock core 50 in a retracted/unlocked position with travel limit stop 90 and lock lug 75 positioned to allow interchangeable lock core 50 to be slid into and through lock mount 10 to a projected/locked position thereby blocking second sliding panel 42 from relative sliding motion with first sliding panel 40. As shown in FIG. 4, travel limit stop 90 must be in a downward/unlocked position within the core boundary defined by outer surface 49 to allow interchangeable lock core 50 to be slid into lock mount 10. FIG. 5 shows a rear elevational view of lock lug 75 recessed within fantailed slot 70 and thus within the core boundary defined by outer surface 49 so that interchangeable lock core 50 may freely slide into lock mount 10.

As shown in FIG. 6, once lock core 50 is slid into lock mount 10 in a projected/locked position, thereby preventing second sliding panel 42 to move in a sliding relationship with first sliding panel 40, control key 80 may be rotated to a vertical position, as shown in FIG. 6, thereby rotating lock lug 75 out of the core boundary to an extended/locked position so front lock lug face 74 of lock lug 75 comes in direct contact with rear mount lug face 23 of mount lug 35, thereby preventing lock core 50 from being slid in a direction away from second sliding panel 42 and out of lock mount 10. When lock core 50 is in the projected/locked position shown in FIG. 6, rear core face 55 is positioned to lie a distance 28 away from rear mount face 14.

Lock core 50 further includes a body flange 24 which abuts oblong forwardly-facing surface 21 of lock mount 10 preventing lock core 50 from being slid toward second sliding panel 42 and out of lock mount 10. Body flange 24 includes portions which lie outside of the core boundary.

FIG. 7 shows a rear view of lock core 50 with control key 80 in a vertical position, thereby having rotated lock lug 75 out of fantail slot 70 into an extended/locked position that is outside of the core boundary. With lock core 50 in a projected/locked position, travel limit stop 90 may also be moved to an upward/locked position that is outside of the core boundary (as shown in FIG. 9) so that operation of lock lug 75 will allow a user to slide lock core 50 within lock mount 10, but will not allow a user to entirely remove lock core 50 from the lock mount 10.

As shown in FIG. 8, lock core 50 is in a projected/locked position with lock lug 75 in an extended/locked position. Additionally, arrow 44 shows cam 100 pushing up on bottom surface 97 of forearm 96 of travel limit stop 90 to move travel limit stop 90 to an upward/locked position, thereby preventing lock core 50 from being completely removed from lock mount 10.

Figure 10:
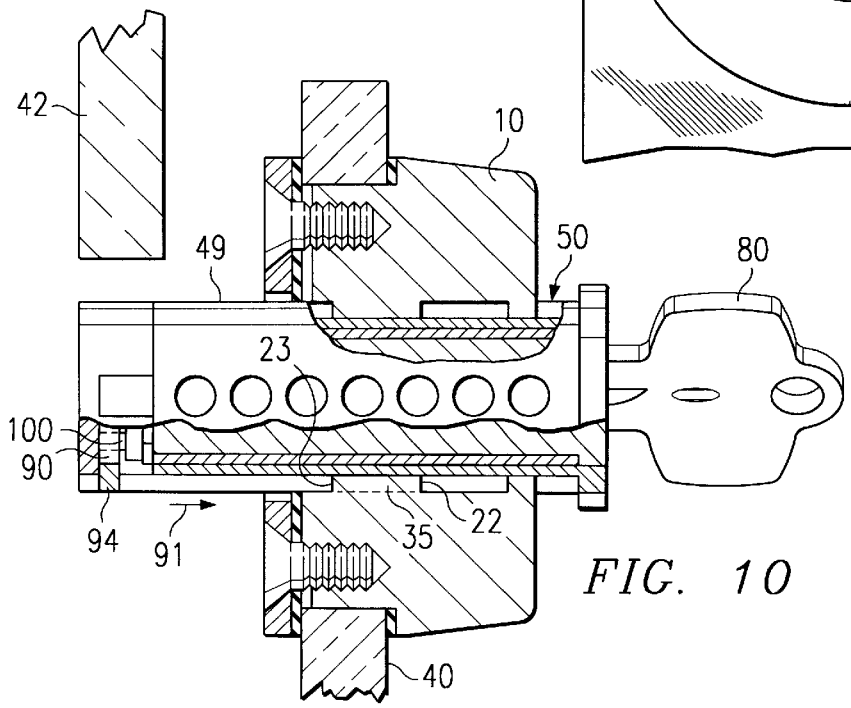
FIG. 10 is a top view, with portions cut away, of the interchangeable lock core in its projected/locked position within the lock mount including the control key inserted into the lock core and rotated approximately 15° clockwise, thereby positioning the lock lug in a recessed/unlocked position and leaving the travel limit stop in an upward/locked position, thereby allowing the lock core to slide within the lock mount, but preventing complete removal of the interchangeable lock core from the lock mount.

As shown in FIG. 9, cam 100, having been rotated in the direction of arrow 83, contacts bottom surface 97 of forearm 96 of the travel limit stop 90 so that elbow 94 of travel limit stop 90 may contact mount lug 35 and prevent lock core 50 from being completely removed from lock mount 10. FIG. 10 shows control key 80 within lock core 50 having been rotated approximately 15 degrees clockwise so that lock lug 75 is in a recessed/unlocked position within the core body permitting sliding movement of lock core 50 within the lock mount 10. However, travel limit stop 90 is in a locked/upward position outside of the core boundary so that when lock core 50 is slid in the direction of arrow 91 away from second sliding panel 42, elbow 94 of travel limit stop 90 contacts rear mount lug face 23 of mount lug 35 preventing complete removal of lock core 50 from the lock mount 10.

Figure 11:
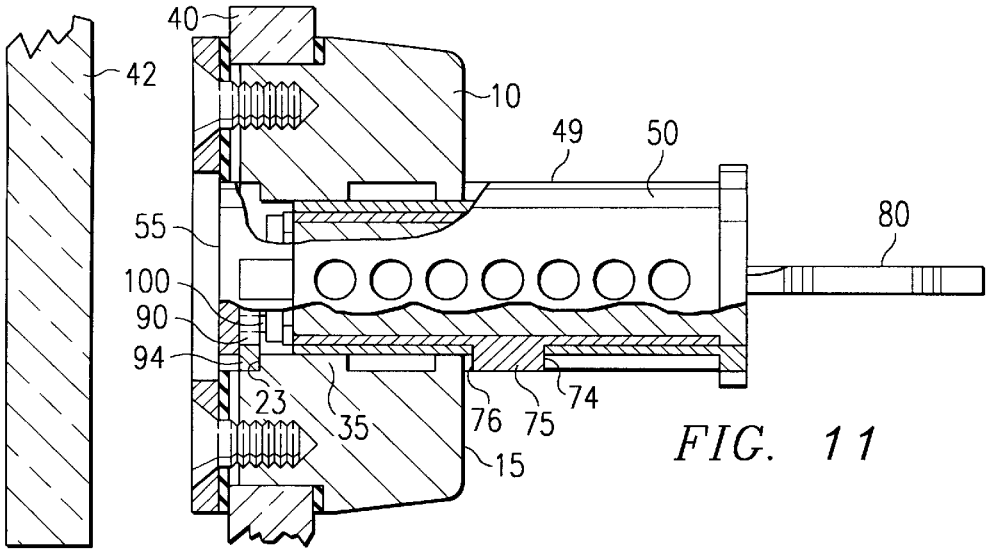
FIG. 11 is a top view, with portions cut away, of the interchangeable lock core slid to a retracted/unlocked position within the lock mount showing the control key inserted into the lock core and rotated back to a vertical position from FIG. 10, thereby positioning the lock lug in an extended/locked position and leaving the travel limit stop in an upward/locked position, thereby allowing the control key to be removed from the lock core.

Although a user in possession of control key 80 will not be able to completely remove lock core 50 from lock mount 10, he will be able to slide lock core 50 within lock mount 10 thereby allowing him to position lock core 50 in a retracted/unlocked position and slide second sliding panel 42 relative to first sliding panel 40. As shown in FIG. 11, lock core 50 has been slid to a retracted/unlocked position within lock mount 10 allowing relative sliding movement between first sliding panel 40 and second sliding panel 42.

In the retracted/unlocked position, rear core face 55 is positioned to lie a distance 29 away from rear mount face 14. Distance 29 is less than distance 28, the distance that rear core face 55 is spaced apart from rear mount face 14 when lock core 50 is in the projected/locked position shown, for example, in FIG. 6. In alternative embodiments, the rear core face 55 may lie within core-receiving chamber 18 when lock core 50 is in the retracted/unlocked position. As also shown in FIG. 11, with lock core 50 in a retracted/unlocked position, elbow 94 of travel limit stop 90 interacts with mount lug 35 preventing lock core 50 from being completely removed from lock mount 10.

As shown in FIG. 11, with lock core 50 in a retracted/unlocked position the user may rotate control key 80 back to a vertical position so that lock lug 75 rotates to an extended/locked position whereby rear lock lug face 76 of lock lug 75 comes in direct contact with front mount face 15 of lock mount 10. In this position, lock core 50 is secured in a retracted/unlocked position with travel limit stop 90 butting up against rear mount lug face 23 of mount lug 35 and rear lock lug face 76 of lock lug 75 butting up against front mount face 15 of the lock mount 10.

Figure 12:
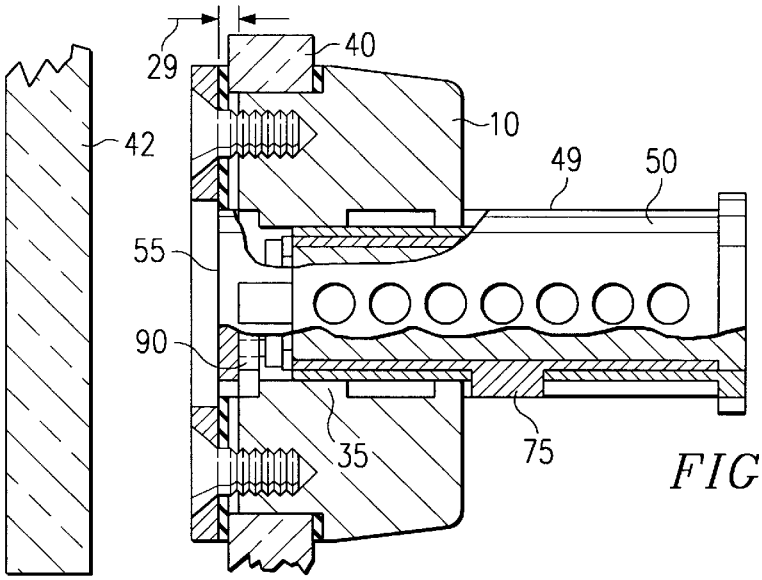
FIG. 12 is a top view, with portions cut away, of the interchangeable lock core in a retracted/unlocked position and the lock mount of FIG. 11 showing the control key removed from the lock core and the travel limit stop and the lock lug in their locked positions, thereby securing the interchangeable lock core in a retracted/unlocked position and permitting the first and second sliding panels to slide freely relative to each other.
Figure 13:
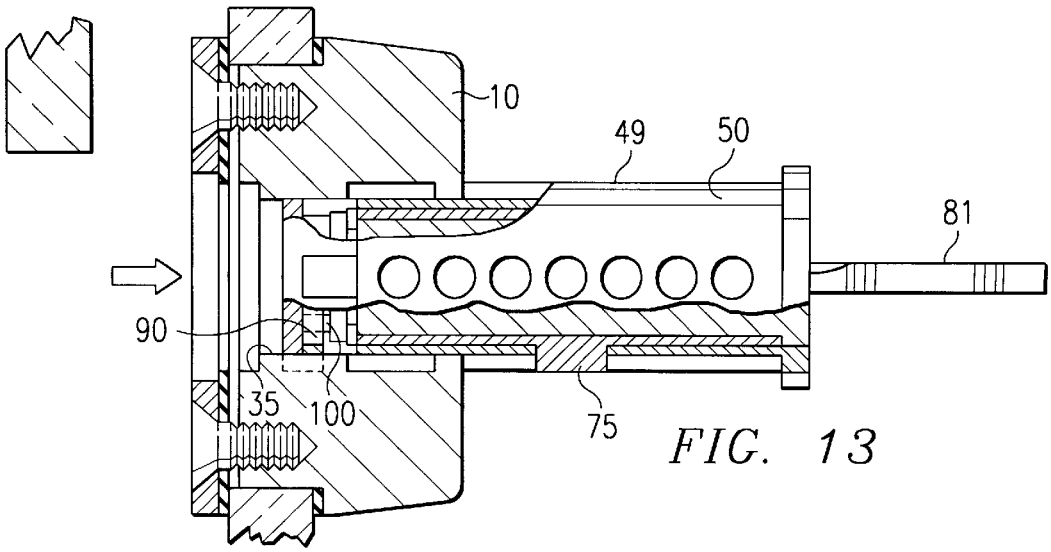
FIG. 13 is a top view, with portions cut away, of the interchangeable lock core and the lock mount of FIG. 12 showing the operation key having been rotated 360° clockwise within the lock core, thereby positioning the travel limit stop in its downward/unlocked position and allowing the interchangeable lock core to be completely removed from the lock mount.

With control key 80 rotated to a vertical position as shown in FIG. 11, control key 80 may be removed from lock core 50 as shown in FIG. 12. This allows a user having control key 80 to position lock core 50 in a retracted/unlocked position, thereby allowing relative sliding movement of first 40 and second 42 sliding panels, and remove key 80 from lock core 50. As shown in FIG. 13, operation key 81 may be placed in key way 72 to rotate cam 100 so that it contacts top face 95 of forearm 96 of travel limit stop 90 and rotates travel limit stop 90 to a downward/unlocked position outside of the core body, thereby permitting a user of operation key 81 to completely remove lock core 50 from lock mount 10.

Figure 14:
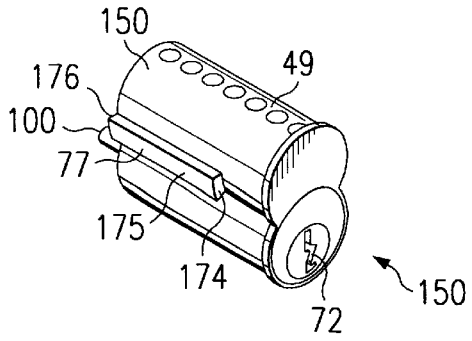
FIG. 14 is a perspective view of another embodiment of an interchangeable lock core having a lock lug extending to a rear face of the lock core.

A second embodiment of the locking mechanism is shown in FIGS. 14–20. This locking mechanism includes a lock core 150 having a lock lug 175 that extends to rear core face 155 of lock core 150 so that rear lock lug face 176 of lock lug 175 lies in the same plane as rear core face 155 of lock core 150, as shown in FIG. 14. Front lock lug face 174 of lock lug 175 remains in the same plane as it did in the first embodiment. Other than lock lugs 75, 175 of lock cores 50, 150, the components of the locking mechanisms of the first and second embodiments are identical and thus are numbered identically.

Figure 15:
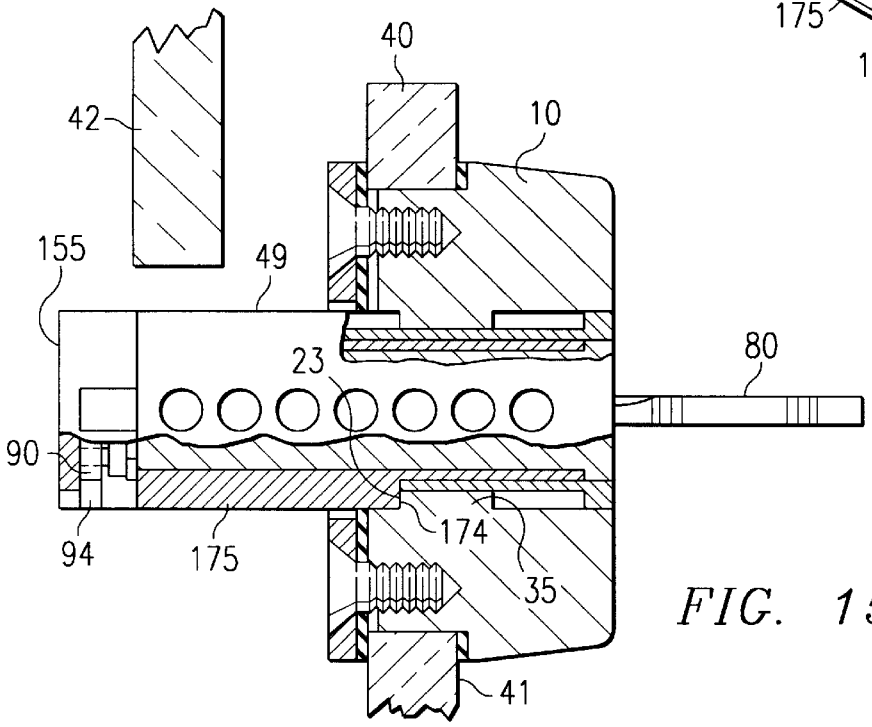
FIG. 15 is a top view, with portions cut away, of an interchangeable lock core in its projected/locked position within the lock mount, including the control key in its vertical position within the lock core, thereby positioning the lock lug in its extended/locked position and restricting sliding movement of the first and second sliding panels.
Figure 16:
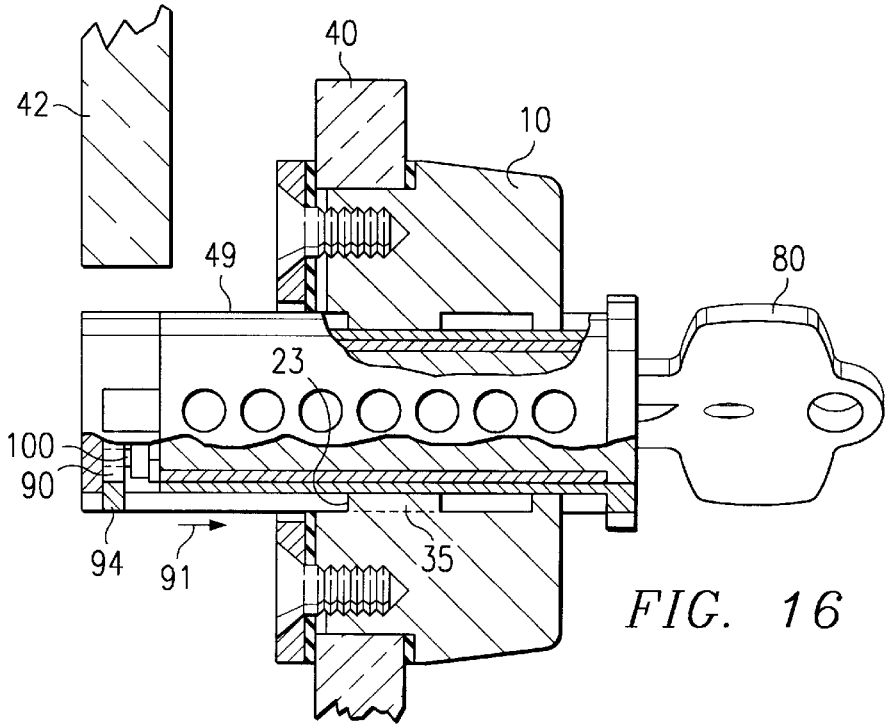
FIG. 16 is a top view, with portions cut away, of the interchangeable lock core of FIG. 15 in a projected/locked position within the lock mount, including the control key rotated approximately 15° clockwise within the lock core, thereby positioning the lock lug in a recessed/unlocked position, thereby allowing the interchangeable lock core to slidably move within the lock mount and with the travel limit stop in an upward/locked position to prevent complete removal of the lock core from the lock mount.

As shown in FIG. 15, with lock core 150 in a projected/locked position and control key 80 in a vertical position, front lock lug face 174 of lock lug 175 abuts rear mount lug face 23 of mount lug 35 preventing relative sliding movement of lock core 150 within lock mount 10. As shown in FIG. 16, with control key 80 rotated approximately 15° clockwise so that lock lug 175 is recessed within fantail slot 70 and the core boundary, lock core 150 may be slidably moved within lock mount 10 in the direction of arrow 91 so that elbow 94 of travel limit stop 90 contacts rear mount lug face 23 of mount lug 35 allowing lock core 150 to slidably move within lock mount 10, but preventing lock core 150 from being entirely removed from lock mount 10.

Figure 17:
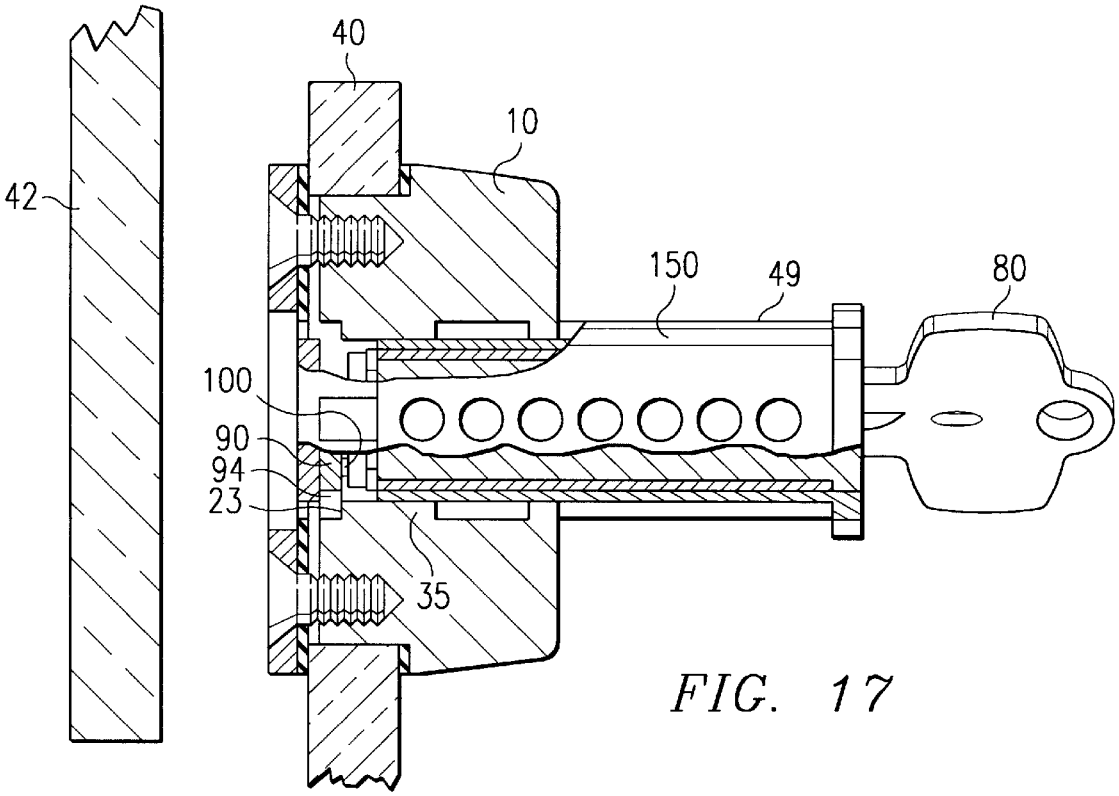
FIG. 17 is a top view, with portions cut away, of the interchangeable lock core of FIG. 16 in a retracted/unlocked position showing the control key rotated approximately 15° clockwise within the lock core, thereby positioning the lock lug in a recessed/unlocked position, thereby allowing the interchangeable lock core to slide to a retracted/unlocked position within the lock mount and with the travel limit stop in an upward/locked position, thereby preventing complete removal of the interchangeable lock core from the lock mount and permitting unrestricted relative sliding movement of the first and second sliding panels.

FIG. 17 shows lock core 150 in a retracted/unlocked position with elbow 94 of travel limit stop 90 abutting rear mount lug face 23 of mount lug 35 preventing lock core 150 from being entirely removed from lock mount 10, but allowing first panel 40 to slide relative to second panel 42.

As shown in FIG. 17, in this embodiment, unlike the first embodiment as shown in FIG. 12, control key 80 may not be removed from lock core 150 with lock core 150 in a retracted/unlocked position. This is because, with lock core 150 in a retracted position, lock lug 175 may not rotate to an extended/locked position, thereby allowing control key 80 to be removed, because an aft portion 77 (shown in FIG. 14) of lock lug 175 is hindered by mount lug 35.

Figure 18:
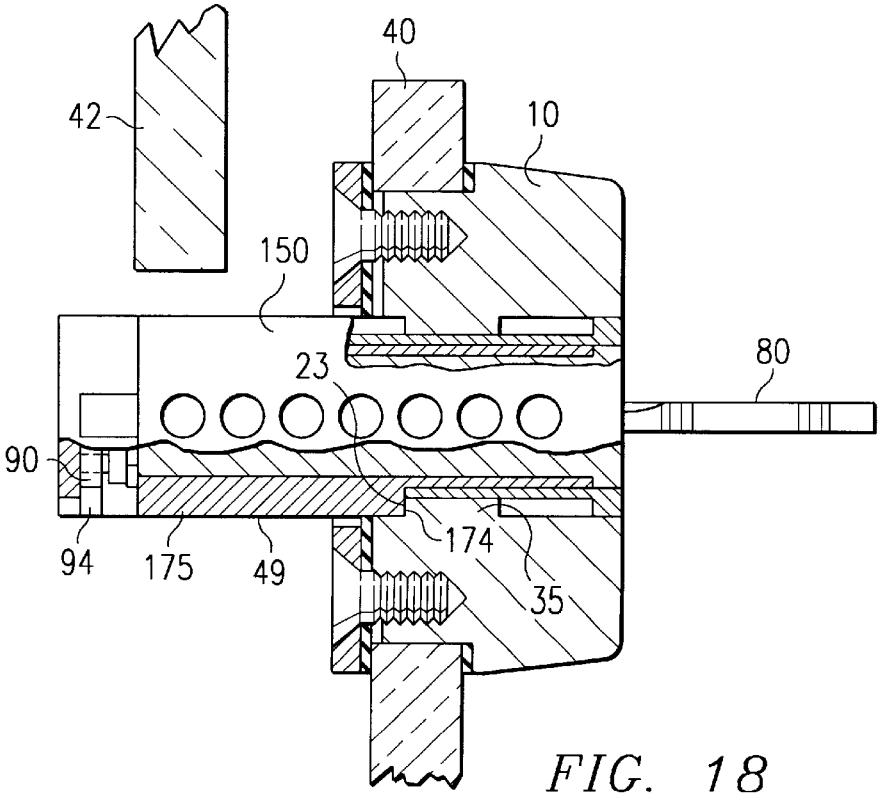
FIG. 18 is a top view, with portions cut away, of the interchangeable lock core of FIG. 17 returned to a projected/locked position showing the control key rotated back to a vertical position within the lock core from FIG. 17, thereby positioning the lock lug in an extended/locked position allowing the control key to be removed from the lock core.
Figure 19:
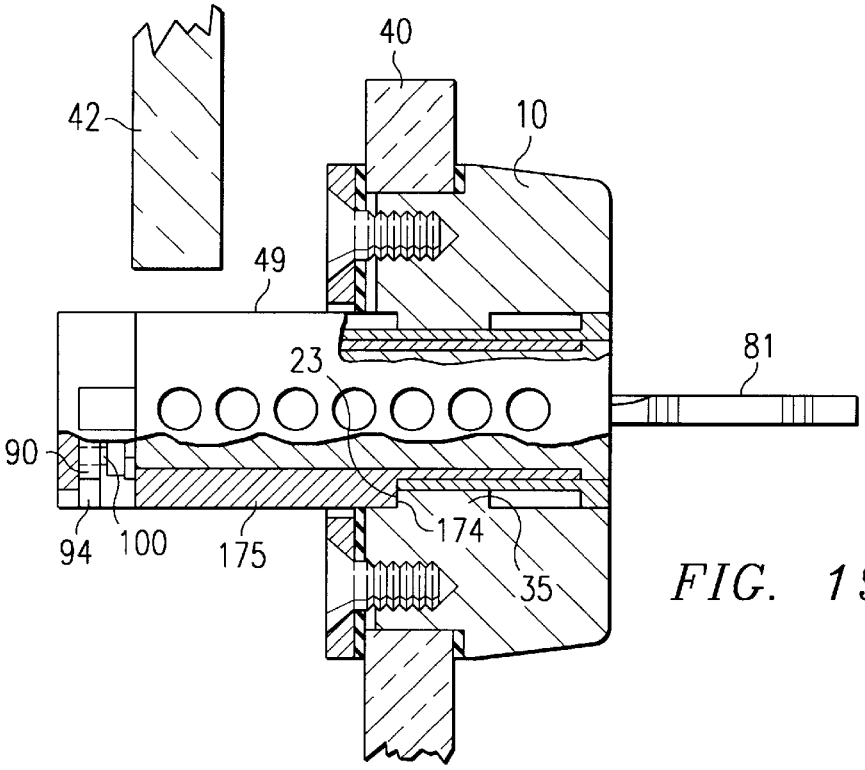
FIG. 19 is a top view, with portions cut away, of the interchangeable lock core of FIG. 18 in a projected/locked position showing the operation key having been rotated within the lock core 360° clockwise, thereby positioning the travel limit stop in a downward/unlocked position.
Figure 20:
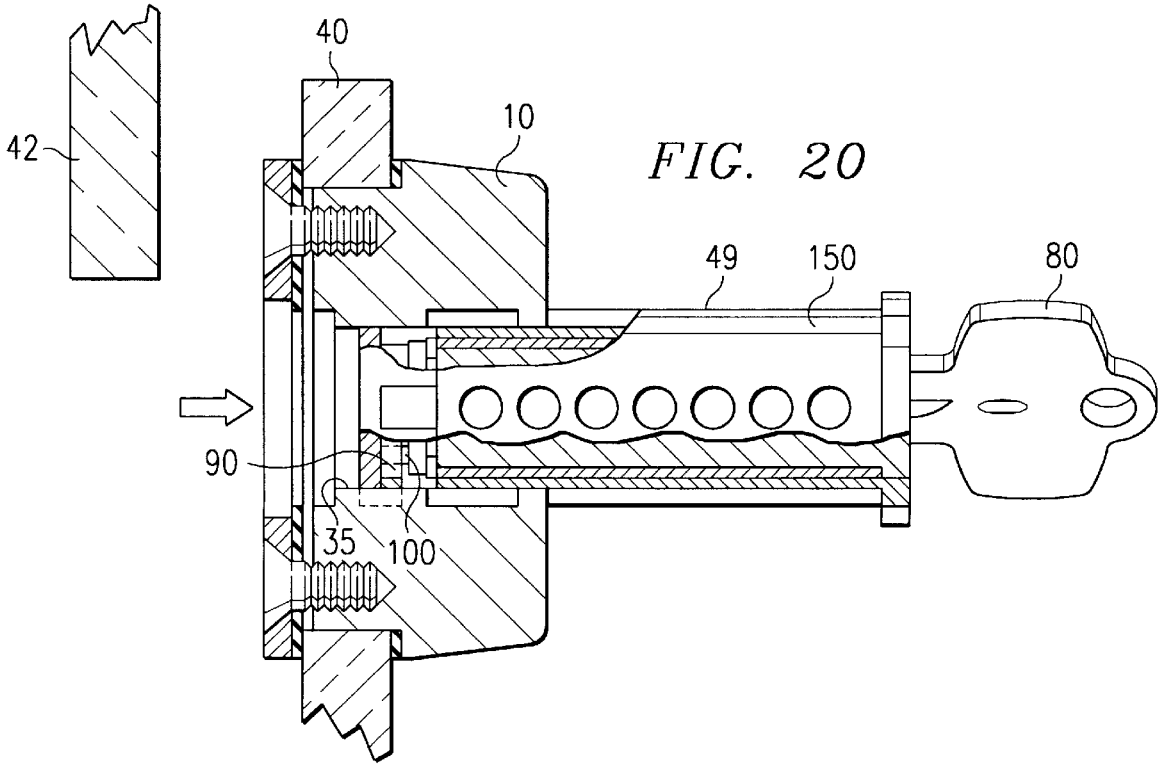
FIG. 20 is a top view, with portions cut away, of the interchangeable lock core of FIG. 19 in a retracted/unlocked position within the lock mount, including the travel limit stop in a downward/unlocked position and the control key having been rotated approximately 15° clockwise, thereby positioning the lock lug, in a recessed/unlocked position permitting complete removal of the interchangeable lock core from the lock mount.

To effect complete removal of lock core 150 from lock mount 10 in the second embodiment, lock core 150 must first be returned to a projected/locked position, as shown in FIG. 18. With lock core 150 in a projected/locked position, control key 80 may be rotated back to a vertical position, thereby extending locking lock lug 175 and allowing removal of control key 80 from lock core 150. Then, as shown in FIG. 19, operation key 81 may be inserted into lock core 150 and rotated clockwise 360°, thereby positioning travel limit stop 90 in a downward/unlocked position. Then, as shown in FIG. 20, with travel limit stop 90 in a downward/unlocked position control key 80 may be reinserted into lock core 150 and rotated approximately 15° clockwise to position lock lug 175 in a recessed/unlocked position within fantail slot 70, thereby allowing complete removal of lock core 150 from lock mount 10.

Although this invention has been described in detail, variations and modifications exist within the scope and spirit of the invention as described and as defined in the following claims.

What is claimed is:

1. A locking mechanism comprising:

a lock mount including front and rear mount faces and an inner mount wall defining a core-receiving chamber extending from the front mount face to the rear mount face, and a lock core including front and rear core faces and a core body extending between the front and rear core faces, the core body having an outer core surface defining a core boundary, the lock core being slidably mounted within the core-receiving chamber of the lock mount and being movable between a projected position wherein the rear core face is positioned away from the rear mount face of the lock mount by a first distance and a retracted position wherein the rear core face is positioned one of within the core-receiving chamber and away from the rear mount face by a second distance that is less than the first distance, the lock core further including a lock lug coupled to the core body and movable between a first lug position outside the core boundary and a second lug position within the core boundary, a travel limit stop coupled to the core body and movable between a first limit stop position outside the core boundary and a second limit stop position within the core boundary, and a key plug rotatable within the core body which interacts with the travel limit stop to move the travel limit stop between the first and second limit stop positions.

2. The locking mechanism of claim 1, wherein the lock core includes a cam that is coupled to the key plug of the lock core and interacts with the travel limit stop through a lost motion driving connection between the cam and travel limit stop to move the travel limit stop between the first and second limit stop positions.

3. The locking mechanism of claim 2, wherein the travel limit stop includes a forearm having a bottom surface and wherein the cam interacts with the bottom surface of the forearm of the travel limit stop to move the travel limit stop between the first and second limit stop positions.

4. The locking mechanism of claim 3, wherein the lock core includes a casing having an alignment channel and slot and the travel limit stop includes a pin slidably positioned within the slot and an alignment lug slidably positioned within the alignment channel.

5. The locking mechanism of claim 4, wherein the core body includes upper and lower lobes and a body groove positioned at the interface of the upper and lower lobes, the casing includes a casing groove, the body groove and casing groove cooperate to define a stop channel, and wherein the travel limit stop intersects the stop channel when the travel limit stop is in a first limit stop position outside the core boundary.

6. The locking mechanism of claim 5, wherein the lock mount includes a mount depth between the front and rear mount faces, the lock lug having front and rear lock lug faces, and the distance between the rear lock lug face and the travel limit stop is greater than the mount depth.

7. The locking mechanism of claim 3, wherein the core body includes upper and lower lobes and a body groove positioned at the interface of the upper and lower lobes, the lock core further includes a casing coupled to the core body that has a casing groove, the body groove and casing groove cooperate to define a stop channel, and wherein the travel limit stop intersects the stop channel when the travel limit stop is in a first limit stop position outside the core boundary.

8. The locking mechanism of claim 2, wherein the lock core includes a casing having an alignment channel and slot and the travel limit stop includes a pin slidably positioned within the slot and an alignment lug slidably positioned within the alignment channel.

9. The locking mechanism of claim 8, wherein the core body includes upper and lower lobes and a body groove positioned at the interface of the upper and lower lobes, the casing includes a casing groove, the body groove and casing groove cooperate to define a stop channel, and wherein the travel limit stop intersects the stop channel when the travel limit stop is in a first limit stop position outside the core boundary.

10. The locking mechanism of claim 1, wherein the core body includes upper and lower lobes and a body groove positioned at the interface of the upper and lower lobes and the travel limit stop intersects the body groove when the travel limit stop is in a first limit stop position outside the core boundary.

11. The locking mechanism of claim 10, wherein the lock mount includes a mount depth between the front and rear mount faces, the lock lug having front and rear lock lug faces, and the distance between the rear lock lug face and the travel limit stop is greater than the mount depth.

12. The locking mechanism of claim 1, wherein the lock core includes a casing having an alignment channel and slot and the travel limit stop includes a pin slidably positioned within the slot and an alignment lug slidably positioned within the alignment channel.

13. The locking mechanism of claim 12, wherein the core body includes upper and lower lobes and a body groove positioned at the interface of the upper and lower lobes, the casing includes a casing groove, the body groove and casing groove cooperate to define a stop channel, and wherein the travel limit stop intersects the stop channel when the travel limit stop is in a first limit stop position outside the core boundary.

14. The locking mechanism of claim 12, wherein the lock core includes a longitudinal axis extending between the front and rear core faces and the pin and alignment lug travel through the slot and alignment channel, respectively, along a path that is substantially perpendicular to the longitudinal axis of the lock core.

15. The locking mechanism of claim 1, wherein the lock core includes a longitudinal axis extending between the front and rear core faces and the travel limit stop moves in a direction perpendicular to the longitudinal axis between the first and second limit stop positions.

16. The locking mechanism of claim 15, wherein the lock lug of the lock core moves about an axis that is substantially parallel to the longitudinal axis of the lock core between the first and second lug positions.

17. The locking mechanism of claim 1, wherein the lock core includes a longitudinal axis extending between the front and rear core faces and the core boundary of the core body is defined by the largest cross section of the core body taken along a plane perpendicular to the longitudinal axis of the lock core.

18. A locking mechanism comprising:

a lock mount including front and rear mount faces and an inner mount wall defining a core-receiving chamber and extending from the front mount face to the rear mount face, and a lock core including spaced-apart front and rear core faces, first and second core end portions, and a core middle portion positioned between the first core end portion and the second core end portion, the core middle portion including an outer core surface defining a core boundary, the lock core being slidably mounted within the core-receiving chamber of the lock mount and being movable between a projected position wherein the rear core face is positioned away from the core-receiving chamber by a first distance and a retracted position wherein the rear core face is positioned one of within the core-receiving chamber and away from the core-receiving chamber by a second distance that is less than the first distance, the lock core further including a lock lug coupled to the core middle portion and movable between a first lug position outside the core boundary and a second lug position within the core boundary, a travel limit stop coupled to the second core end portion and movable between a first limit stop position outside the core boundary and a second limit stop position within the core boundary, and a cam coupled to the second core end portion which interacts with the travel limit stop to move the travel limit stop between the first and second limit stop positions.

19. A locking mechanism configured to lock first and second sliding panels comprising:

a lock mount including a core-receiving chamber, and a lock core including front and rear core faces and a core body extending between the front and rear core faces, the lock core being slidably mounted within the core-receiving chamber of the lock mount and being movable between a projected position wherein the lock core restricts relative movement of the first and second sliding panels and a retracted position wherein the first and second sliding panels are permitted to move freely relative to each other, the lock core further including a lock lug coupled to the core body and movable relative to the core body, a travel limit stop coupled to the core body and movable between first and second limit stop positions, and a key plug rotatable within the core body which interacts with the travel limit stop through a lost motion driving connection between the key plug and the travel limit stop to move the travel limit stop between the first and second limit stop positions.

20. A locking mechanism configured to lock first and second sliding panels comprising:

a lock mount including a core-receiving chamber, and a lock core including front and rear core faces, a core body extending between the front and rear core faces and a longitudinal axis extending between the front and rear core faces, the lock core being slidably mounted within the core-receiving chamber of the lock mount and being movable between a projected position wherein the lock core restricts relative movement of the first and second sliding panels and a retracted position wherein the first and second sliding panels are permitted to move freely relative to each other, the lock core further including a lock lug coupled to the core body and movable relative to the core body, a travel limit stop coupled to the core body and movable between first and second limit stop positions, and a key plug rotatable within the core body which interacts with the travel limit stop to move the travel limit stop in a direction perpendicular to the longitudinal axis of the lock core between the first and second limit stop positions.

21. A locking mechanism configured to lock first and second sliding panels comprising:

a lock mount including a core-receiving chamber, and a lock core including front and rear core faces, a core body extending between the front and rear core faces and having upper and lower lobes and a body groove positioned at the interface of the upper and lower lobes, and a casing having a casing groove wherein the casing groove and body groove cooperate to define a stop channel, the lock core being slidably mounted within the core-receiving chamber of the lock mount and being movable between a projected position wherein the lock core restricts relative movement of the first and second sliding panels and a retracted position wherein the first and second sliding panels are permitted to move freely relative to each other, the lock core further including a lock lug coupled to the core body and movable relative to the core body, a travel limit stop coupled to the core body and movable between first and second limit stop positions, and a key plug rotatable within the core body which interacts with the travel limit stop to move the travel limit stop between the first and second limit stop positions and wherein the travel limit stop intersects the stop channel when the travel limit stop is in a first limit stop position.

* * * * *